US007070182B2

(12) United States Patent
Hasegawa

(10) Patent No.: US 7,070,182 B2
(45) Date of Patent: Jul. 4, 2006

(54) SHEET SEPARATING MECHANISM, FIXING DEVICE, AND IMAGE FORMING APPARATUS

(75) Inventor: Kenichi Hasegawa, Kanagawa (JP)

(73) Assignee: Ricoh Company, Limited, Tokyo (JP)

( * ) Notice: Subject to any disclaimer, the term of this patent is extended or adjusted under 35 U.S.C. 154(b) by 0 days.

(21) Appl. No.: 10/737,851

(22) Filed: Dec. 18, 2003

(65) Prior Publication Data

US 2004/0178573 A1 Sep. 16, 2004

(30) Foreign Application Priority Data

Dec. 18, 2002 (JP) ..... 2002-366757

(51) Int. Cl.
*B65H 29/54* (2006.01)

(52) U.S. Cl. ..... 271/307; 399/323; 399/399

(58) Field of Classification Search ..... 271/307, 271/308, 312, 313; 399/398, 399, 323
See application file for complete search history.

(56) References Cited

U.S. PATENT DOCUMENTS 4,364,657 A * 12/1982 Landa ..... 399/398
4,408,757 A * 10/1983 Yarm ..... 271/311
5,138,391 A * 8/1992 Takahashi et al. ..... 399/327
5,400,123 A 3/1995 Sato et al.
5,448,347 A * 9/1995 Mills ..... 399/323
5,802,434 A * 9/1998 Takehara et al. ..... 399/323
5,822,668 A * 10/1998 Fromm et al. ..... 399/323
6,029,039 A * 2/2000 Aslam et al. ..... 399/323
6,131,009 A 10/2000 Hasegawa
6,205,316 B1 * 3/2001 Iida ..... 399/323
6,259,881 B1 * 7/2001 Nakamura ..... 399/323
6,490,428 B1 * 12/2002 Fromm et al. ..... 399/323
6,496,666 B1 12/2002 Hayashi et al.
6,591,081 B1 7/2003 Hasegawa
6,658,229 B1 * 12/2003 Ando et al. ..... 399/323
6,813,464 B1 * 11/2004 Amita et al. ..... 399/323
6,909,870 B1 * 6/2005 Lee ..... 399/323

FOREIGN PATENT DOCUMENTS

JP 8-272259 10/1996

* cited by examiner

*Primary Examiner*—Kathy Matecki
*Assistant Examiner*—Matthew J. Kohner
(74) *Attorney, Agent, or Firm*—Oblon, Spivak, McClelland, Maier & Neustadt, P.C.

(57) ABSTRACT

A sheet separating mechanism includes a separation claw arranged on the surface of a rotatable member such that the separation claw can be rotated around a shaft of the rotatable member with which a claw portion can be brought into slidable contact. A holder rotatably holds the separation claw through the rotating shaft, the holder being rotatably arranged on an attaching portion of the body of the apparatus. A leaf spring elastically holds the holder at a predetermined position when the holder is attached to the attaching portion.

12 Claims, 7 Drawing Sheets

SHEET SEPARATING MECHANISM, FIXING DEVICE, AND IMAGE FORMING APPARATUS

CROSS-REFERENCE TO RELATED APPLICATIONS

The present document incorporates by reference the entire contents of Japanese priority document, 2002-366757 filed in Japan on Dec. 18, 2002.

BACKGROUND OF THE INVENTION

1) Field of the Invention

The present invention relates to a sheet separating mechanism having a separation claw, a fixing device, and an image forming apparatus.

2) Description of the Related Art

An image forming apparatus includes a fixing device for permanently fixing a toner image on a sheet-like recording medium such as a paper. This fixing device includes a hot fixing roller that is hot, a fixing belt, a pressure roller, and a pressure belt. The fixing roller and the pressure roller are rotatable. The fixing belt is suspended over the fixing roller and the pressure-belt is suspended over the pressure roller. The pressure roller and the pressure belt are in press contact with the fixing roller and the fixing belt; therefore, the pressure roller and the pressure belt rotate when the fixing roller rotates. When the paper with the toner image passes between the pressure roller and the fixing roller and between the pressure belt and the fixing belt; because the fixing roller is hot, the toner melts and gets fixed to the paper.

Sometimes the molten toner, which is a resin, disadvantageously gets adhered to the fixing roller and damages the later images. There are various approaches to avoid the toner getting adhered to the fixing roller. For example, wax may be added to the toner, a mold-releasing material may be coated on the surface of the fixing roller, a mold-releasing material such as silicon oil may be coated on the fixing roller, and so on. Another approach is to provide a sheet separating mechanism having a separation claw that forcibly separates the paper from the fixing roller.

The separation claw has a claw portion and a rotating shaft, and the claw portion is pressured with a spring such that the claw portion is brought into contact with the fixing roller around the rotating shaft. A surface opposing the claw portion with respect to the paper also has a guide shape which directly carries a separated paper.

In the fixing device having such a sheet separating mechanism, when a paper folded like bellows gets jammed near a paper delivery portion, the paper exerts pressure on the separation claw. As a result, the distal end of the claw is pressed on the fixing roller and causes damage to the fixing roller. If there is a layer of an elastic material on the surface of the fixing roller, the distal end of the separation claw breaks into the fixing roller to disadvantageously peel the layer of the elastic material.

Various mechanisms have been proposed for moving the separation claw in such a direction that the separation claw is prevented from breaking into the fixing roller However, there is a problem with those mechanisms in that a lot of parts such as the link mechanisms, springs etc. are required so that the manufacturing cost, or the maintenance cost increases.

In the technology disclosed in Japanese Patent Application laid-open No. 8-272259, a rotating shaft of a separation claw is supported by a groove-like guide to regulate the movement of the separation claw along the groove, and biasing force of a spring for biasing the separation claw to a rotatable member is used to position the separation claw, so that the purpose can be achieved with a simpler configuration.

However, in the sheet separating mechanism described in Japanese Patent Application laid-open No. 8-272259, the separation claw is not positioned until the spring is set in the assembly of the sheet separating mechanism, the separation claw becomes unstable in the setting to deteriorate the assembly properties. Because a tool such as a needle-nose plier is required to set a small spring, reasonable assembling time is required to assemble a plurality of separation claws (in general, 4 to 10 claws). Moreover, when the separation claw moves to twist the rotating shaft, the separation claw may compete with the groove to disadvantageously inhibit the separation claw from smoothly moving.

SUMMARY OF THE INVENTION

A sheet separating mechanism according to the present invention includes a separation claw arranged on the surface of a rotatable member such that the separation claw can be rotated around a shaft of the rotatable member with which a claw portion can be brought into slidable contact; a holder that rotatably holds the separation claw through the rotating shaft, the holder being rotatably arranged on an attaching portion of the body of the apparatus; and a leaf spring that elastically holds the holder at a predetermined position when the holder is attached to the attaching portion.

A fixing device and an image forming apparatus according to the present invention include the sheet separating mechanism according to the present invention.

The other objects, features and advantages of the present invention are specifically set forth in or will become apparent from the following detailed descriptions of the invention when read in conjunction with the accompanying drawings.

DETAILED DESCRIPTION

Exemplary embodiments of a sheet separating mechanism and an image forming apparatus according to the present invention will be described below with reference to the accompanying drawings.

Figure 1:
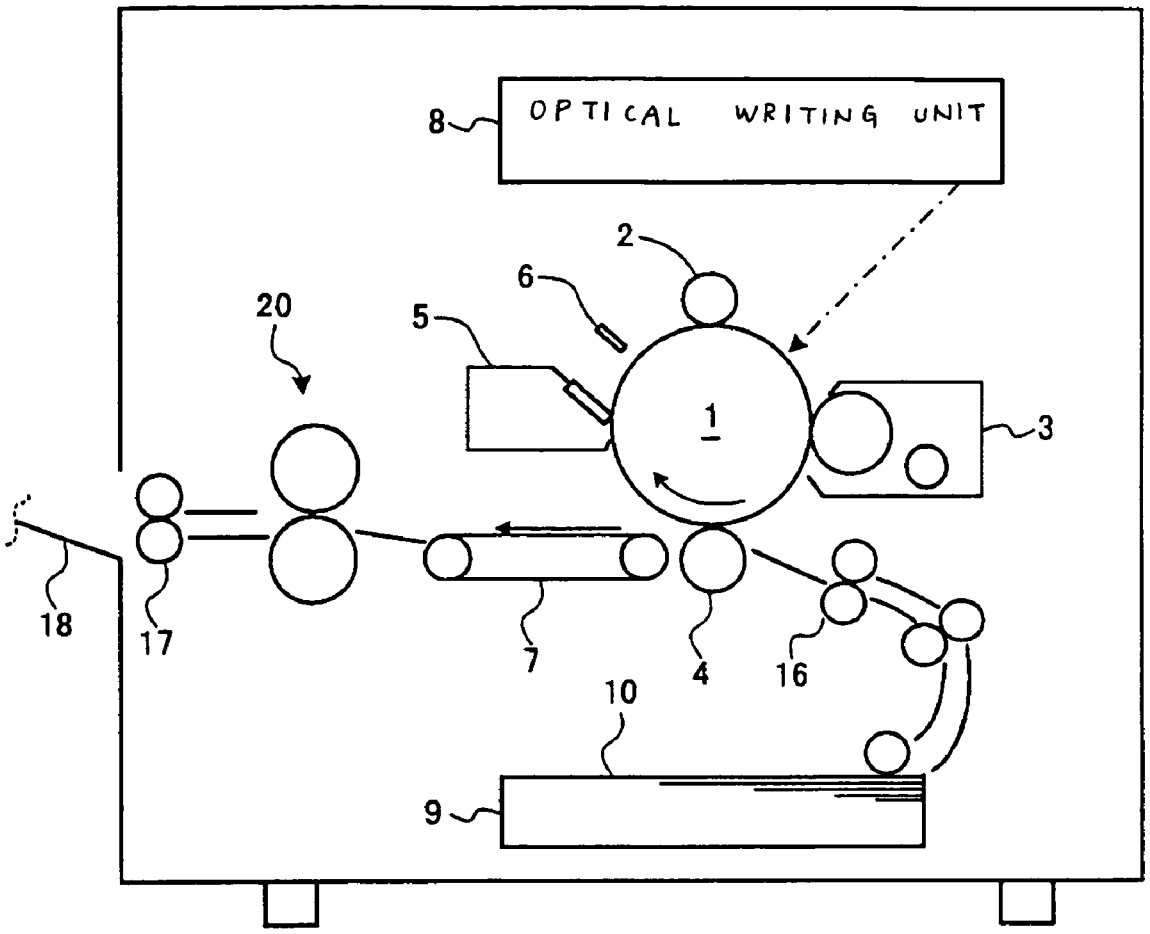
FIG. 1 is a schematic diagram of an image forming apparatus according to an embodiment of the present invention.

FIG. 1 is a schematic diagram of an image forming apparatus with a sheet separating mechanism according to an embodiment of the present invention.

In this image forming apparatus, a photosensitive member 1 serving as an image carrier is rotatably driven by a drive means (not shown) in the direction of an arrow. While the photosensitive member 1 rotates, a charging roller 2 uniformly charges the surface of the photosensitive member. An optical writing unit 8 emits a laser to form an electrostatic latent image on the surface of the charged photosensitive member 1. A developing device develops with toner the electrostatic latent image on the photosensitive member 1 to form a toner image on the photosensitive member 1. A paper 10 in a paper feeder 9 is conveyed to a transfer unit by a resist roller. 16 in accordance with the timing of formation of the toner image. In the transfer unit, the toner image is transferred to the paper 10 by the operation of a transfer roller 4.

A conveyor belt 7 conveys the paper 10 with the toner image to a fixing device 20. In the fixing device 20, the toner image is fixed to the paper 10 as a permanent visible image. The paper 10 with the visible image is then delivered into a paper delivery tray 18 through a paper delivery roller pair 17. A cleaning device 5 cleans any toner remaining on the surface of the photosensitive member 1 after the transfer operation. A discharging device 6 removes any electric charge remaining on the surface of the photosensitive member 1 after the transfer operation. Thus, the photosensitive member 1 is ready for the next image formation.

Figure 2:
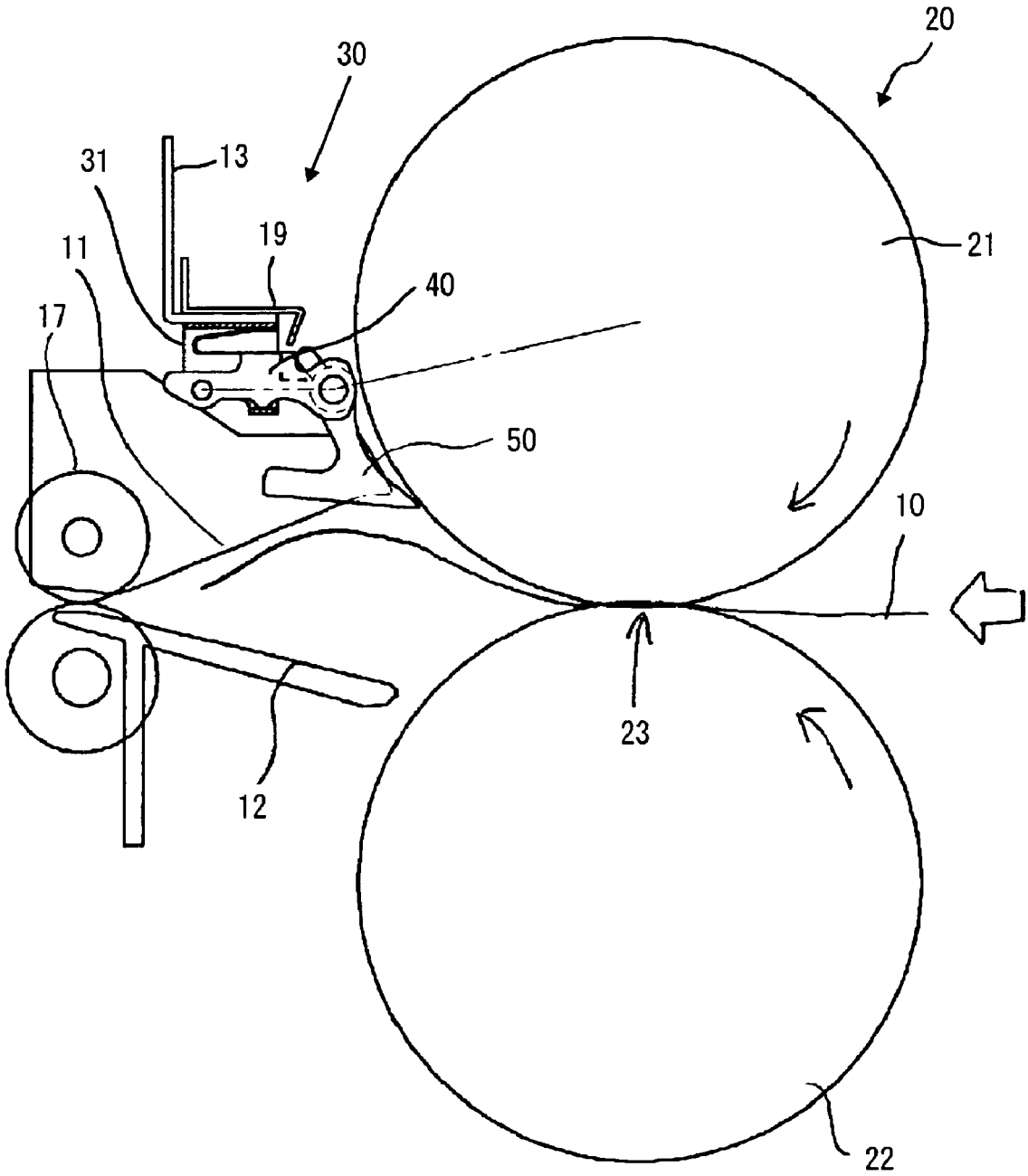
FIG. 2 is a detailed diagram of a fixing device with a sheet separating mechanism according to an embodiment of the present invention.

The fixing device 20 includes the sheet separating mechanism according to the present invention. FIG. 2 is a detailed schematic diagram of the fixing device 20.

The fixing device 20 has a fixing roller 21 and a pressing roller 22 brought into contact with the fixing roller. The fixing roller 21 is an elastic roller having a metal pipe at the core, a silicon rubber layer having a thickness of approximately 0.1 mm to 3 mm on the metal pipe, and a PFA tube having a thickness of 20 μm to 200 μm and coated on the silicon rubber layer. The fixing roller 21 has a heat source such as a halogen lamp (not shown) in the fixing roller 21, and is turned on/off on the basis of a measurement result of a temperature detection element (not shown) for detecting a surface temperature of the fixing roller 21. As a result, the surface temperature of the fixing roller 21 is controlled to be within a predetermined range.

The pressing roller 22 is also an elastic roller having a metal pipe at the core, a silicon rubber layer having a thickness of approximately 1 mm to 5 mm and formed on the surface of the metal pipe, and a PFA tube having a thickness of 20 μm to 200 μm and coated on the surface of the silicon rubber layer. The pressing roller 22 is rotates as a drive means (not shown) rotates the fixing roller 21; because, the pressing roller 22 and the fixing roller 21 are in contact with each other. Reference numerals 11 and 12 denote upper and lower guide plates.

When the paper 10 with the toner image is fed in a nip portion 23 between the fixing roller 21 and the pressing roller 22, the paper 10 is held tightly and conveyed as the fixing roller 21 and the pressing roller 22 rotate. Because the fixing roller 21 is hot, and because the fixing roller 21 and the pressing roller 22 are in tight contact, the toner melts and gets fixed to the paper 10 with heat and pressure. Sometimes the molten toner gets stuck to the fixing roller 21 and the paper gets winded to the fixing roller 21. To prevent the paper getting winded around the fixing roller 21, a sheet separating mechanism 30 having a separation claw 50 for separating the paper 10 from the fixing roller 21 is provided. Four to ten sheet separating mechanisms 30 are arranged in the direction of the width of the paper 10.

Figure 3:
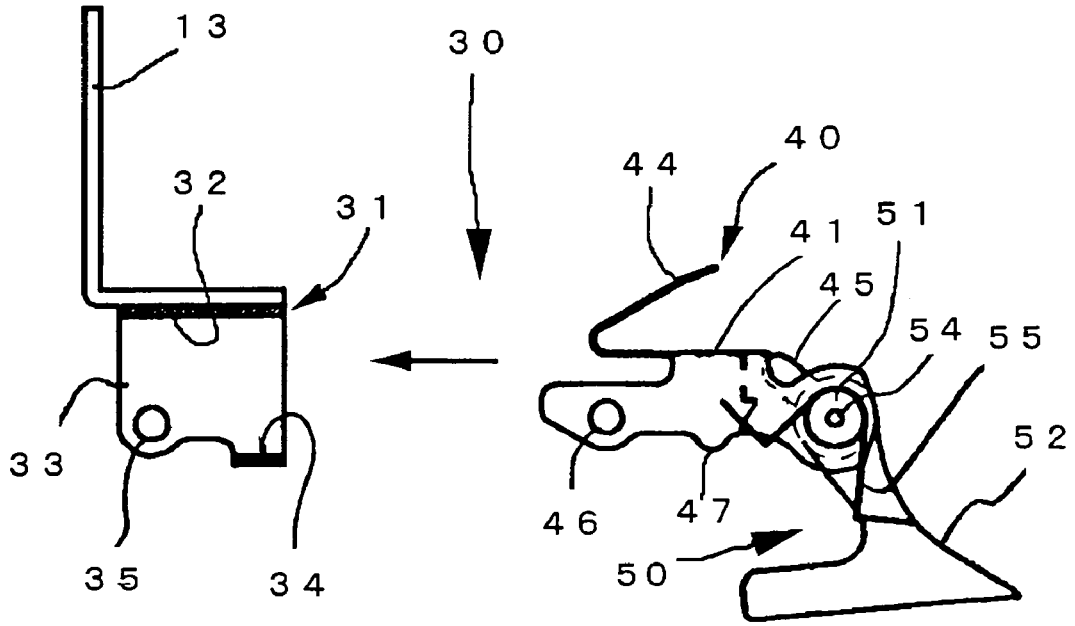
FIG. 3 is a front view of the sheet separating mechanism.
Figure 4:
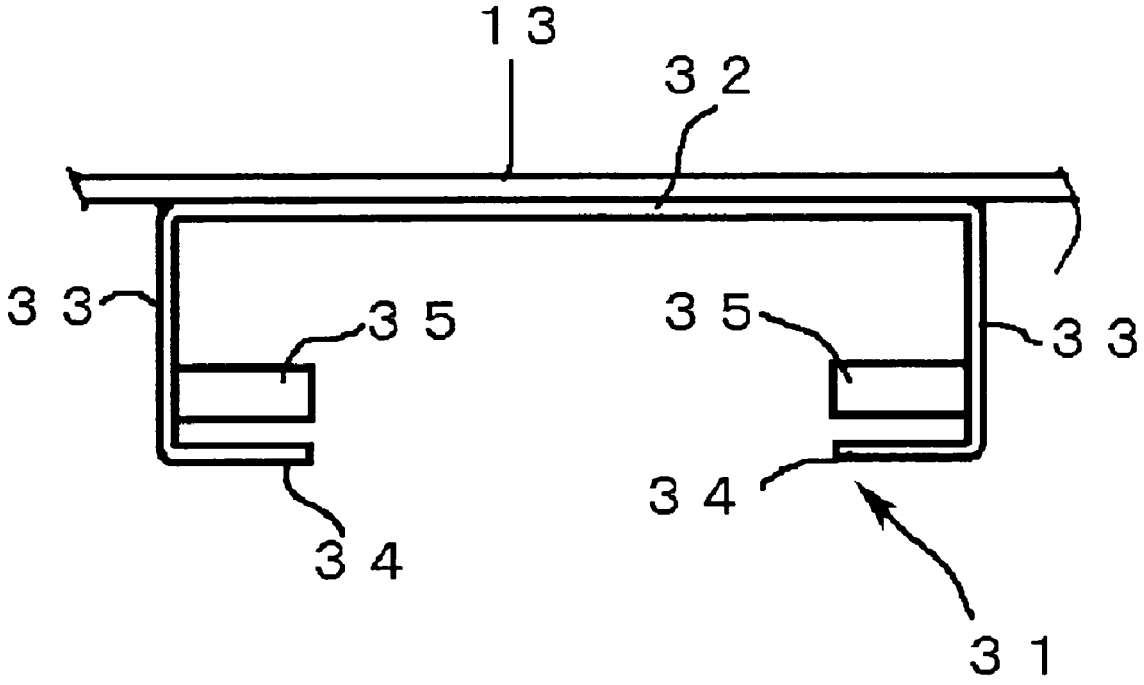
FIG. 4 is a side view of a bracket of the sheet separating mechanism.

The sheet separating mechanism 30, as shown in FIGS. 2 and 3, has a holder 40 for supporting the separation claw 50 and a bracket 31 serving as a attaching unit arranged on a frame 13 of the apparatus body on which the holder 40 is assembled. The frame 13 is constituted by a steel-plate member. The bracket 31 is fixed to the frame 13. The holder 40, as shown in FIG. 4, has a horizontally symmetrical sectional shape obtained by turning a rectangular C-shape by 90.degree. when viewed from the side. More specifically, on the bracket 31, a base 32 fixed to the frame 13, arm portions 33 arranged on both the left and right sides of the base 32, and bent portions 34 arranged at the distal ends of the arm portions 33. Holder rotating shafts 35 which are constituted by short shafts and oppose to each other on the inside are arranged on the arm portions 33. Reference numeral 19 denotes a separation claw stopper for regulating the movement of the separation claw 50 pressed by a jammed paper.

Figure 5:
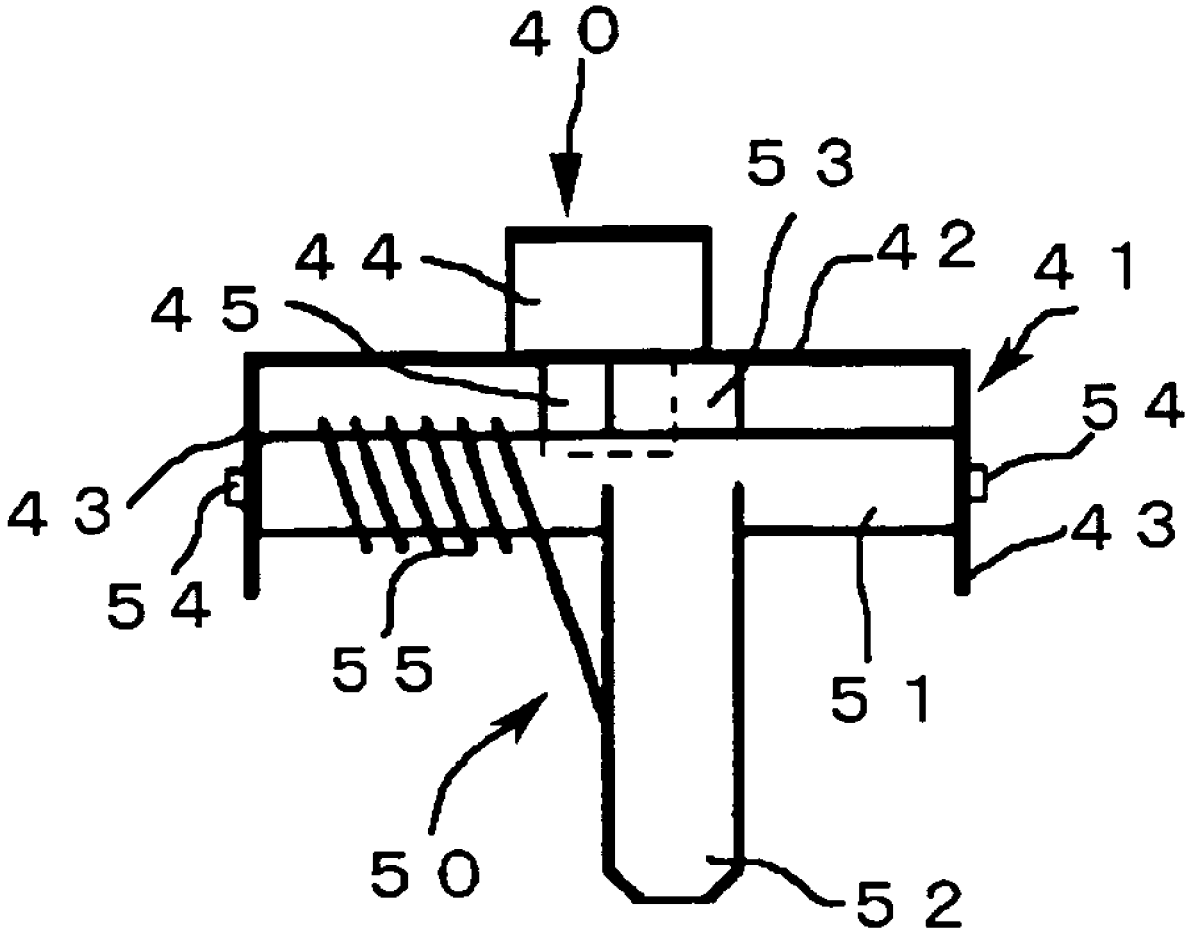
FIG. 5 is a side view of a holder of the sheet separating mechanism.

On the other hand, as shown in FIGS. 3 and 5, a holder member 41 formed to have a horizontally symmetrical sectional shape obtained by turning a U-shape by 90° and a separation claw 50 attached to the holder body 41. The holder member 41 is constituted by a leaf spring consisting of SUS301, and has a basal plate portion 42 horizontally extending in FIG. 5 and a side plate portion 43 hanging from both the sides of the basal plate portion 42. In the holder member 41, a leaf spring 44 is arranged on the upper side of the basal plate portion 42, and a stopper 45 for holding the separation claw 50 at a predetermined position is arranged under the basal plate portion 42. As is apparent from FIG. 3, the side plate portion 43 horizontally extends, and has a small-shaft hole which is formed on the right-end side in FIG. 3 and in which the rotating shaft of a separation claw (to be described later) is fitted. The side plate portion 43 has a rotating-shaft hole 46 which is formed on the left-end side of the side plate portion 43 in which the holder rotating shaft 35 arranged on the arm portion 33 of the bracket 31 is fitted.

The separation claw 50 has a claw portion 52 and a projection 53 which are fixed to a claw rotating shaft 51. These members can be arranged by integrally moulding a heat-resistance resin (e.g., PPS or PEEK). The claw rotating shaft 51 of the separation claw 50 includes a small shaft 54 such that the claw rotating shaft 51 and the small shaft 54 have the same shaft center. The small shaft 54 is fitted in the small-shaft holes formed in the tripod plates 43 of the holder member 41 described above. Since the position of the small-shaft hole is the same as that of the small shaft 54 in FIG. 3 in which the small shaft 54 is fitted in the small-shaft hole, no reference numeral is not given to the small-shaft hole.

In the holder 40, the separation claw 50 is rotatably arranged on the holder member 41 by fitting the small shaft 54 in the small-shaft hole. The holder 40 is completed by arranging a torsional spring 55 for elastically biasing the claw portion 52 of the separation claw 50 in such a direction that the claw portion 52 is brought into contact with the fixing roller 21. The arrangement of the torsional spring 55 is a cumbersome operation. However, in the present invention, since the operation can be performed before the separation claw 50 is built in the image forming apparatus, the operation can be easily performed.

In this manner, when the holder 40 having the separation claw 50 arranged therein, as shown in FIG. 3, the holder 40 is inserted into the bracket 31 along the direction of an arrow P, and the assembly of the sheet separating mechanism 30 is completed by only fitting the holder rotating shaft 35 in the rotating-shaft hole 46. At this time, when the holder 40 is inserted into the bracket 31 such that bottoms 47 of the side plate portions 43 of the holder member 41 keep in contact with the bent portion 34, the leaf spring 44 arranged on the holder member 41 is elastically transformed in such a direction that the leaf spring 44 is bent. After the holder 40 is inserted into the bracket 31, the leaf spring 44 is elastically transformed, and the holder 40 is integrally held in the bracket 31 by the operation of the leaf spring 44. More specifically, the widths of the base 32 of the bracket 31 and the bent portion 34 are smaller than the distance between the end of the leaf spring 44 and a holder bottom 47 and larger than the vertical width of the side plate portion 43 of the holder member 41. For this reason, when the holder 40 is inserted into the bracket, the bottom 47 is held by the elasticity of the leaf spring 44 such that the bottom 47 is in press contact with the bent portion 34. In the assembly of the holder 40, since the holder member 41 is constituted by a leaf spring material, the holder rotating shaft 35 can be easily fitted in the rotating-shaft hole 46 by temporarily elastically transforming the side plate portion 43.

In this manner, the sheet separating mechanism 30 is built in the apparatus such that the holder is assembled. For this reason, the sheet separating mechanism 30 can be very easily built in the apparatus. An aspect of the operation of the sheet separating mechanism 30 which is completely built in the apparatus will be described below with reference to FIGS. 6 and 7.

Figure 6:
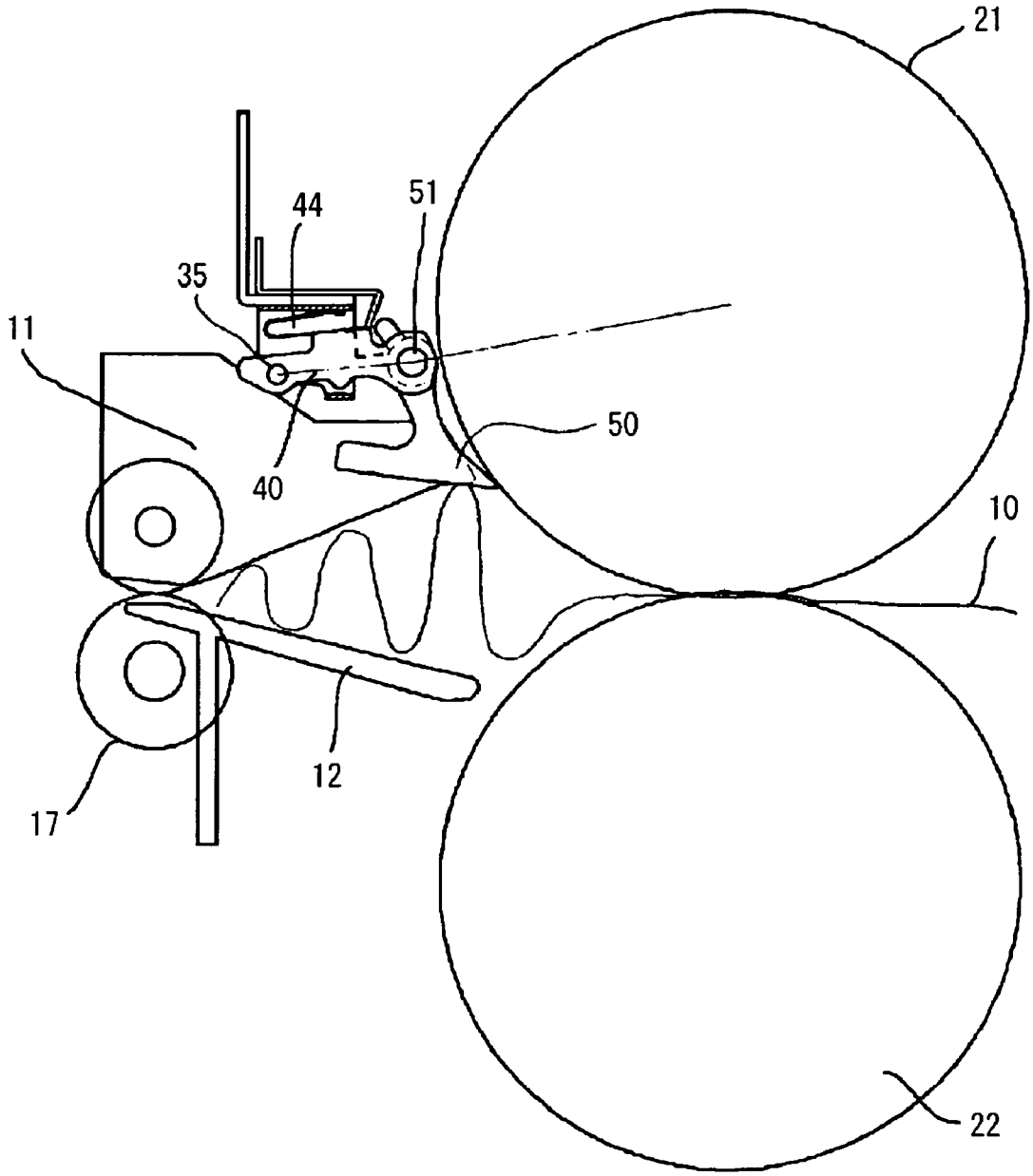
FIG. 6 is to explain jamming of paper.

As shown in FIG. 6, when the paper 10 is jammed with reference to the paper delivery rollers 17, the fixing roller 21 is continuously rotated until a sheet sensor (not shown) arranged on the downstream side of the paper delivery rollers detects that the paper does not arrive. For this reason, when the jammed paper has been clogged in the shape of bellows between the upper and lower guide plates 11 and 12, the paper 10 lifts the bottom of the separation claw 50 upward. At this time, when the holder 40 counterclockwise rotates around the holder rotating shaft 35 against the action of the leaf spring 44, the separation claw 50, so that the separation claw 50 retreated into the upper guide plate 11. In this stage, since force used when the paper 10 presses the separation claw 50 is converted into force for moving the separation claw 50 around holder rotating shaft 35, the fixing roller 21 is not scratched by pressing the separation claw 50 onto the fixing roller 21.

Figure 7:
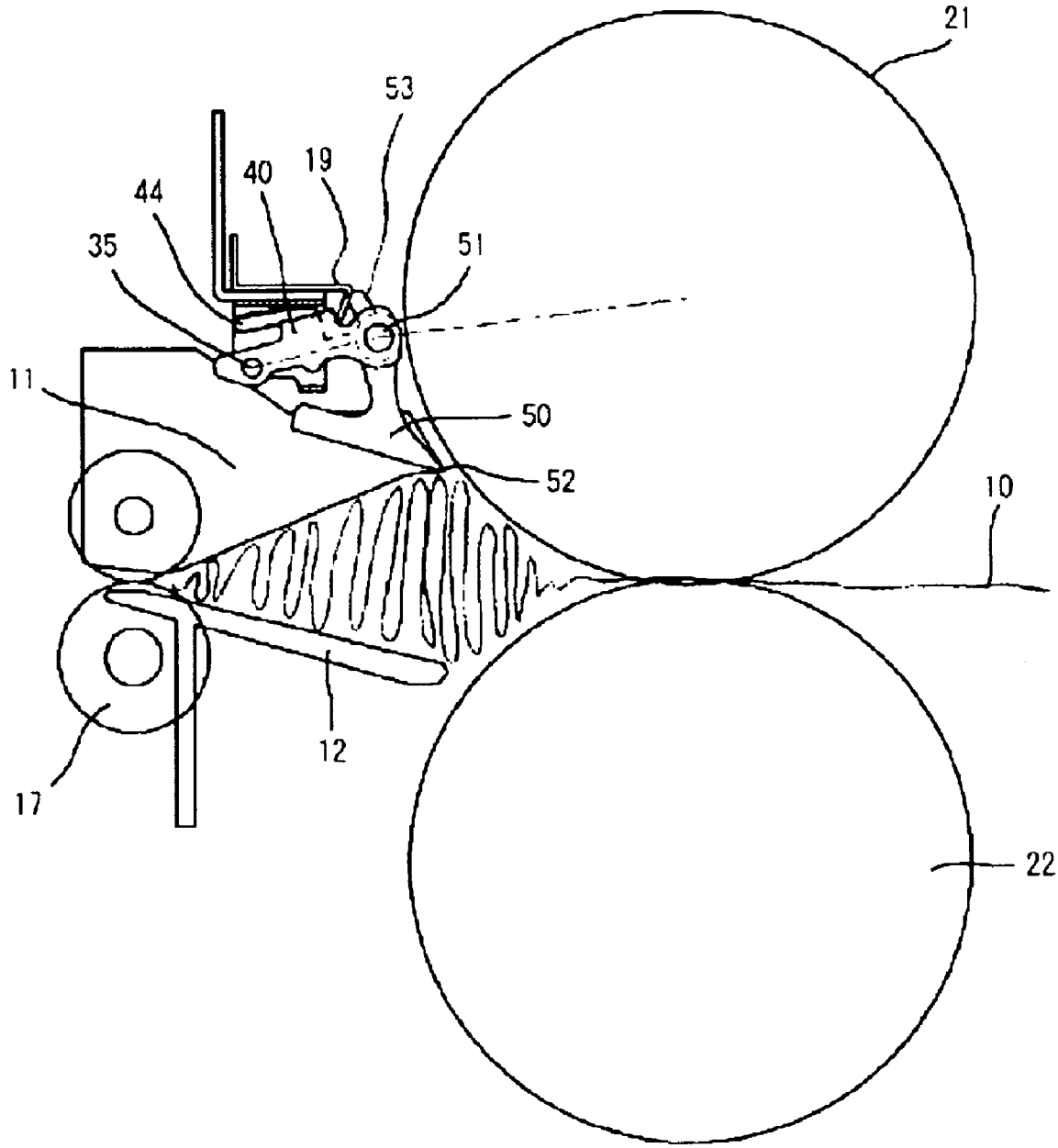
FIG. 7 is to explain advancing of the jamming of the paper.
Figure 8:
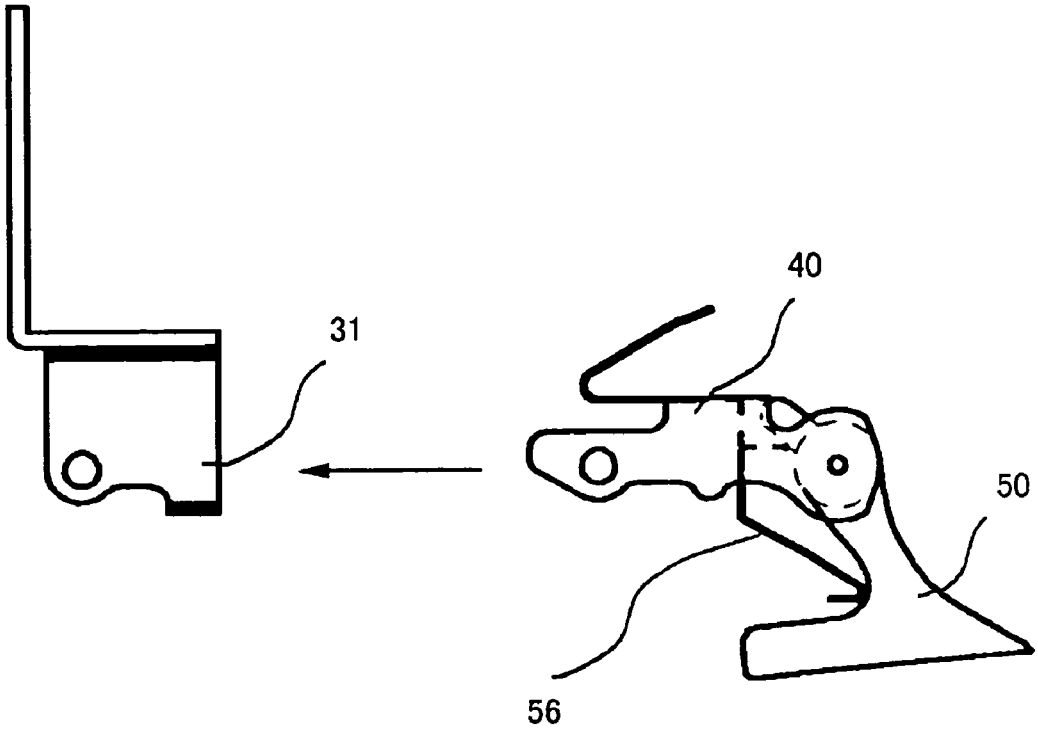
FIG. 8 is a front view of a sheet separating mechanism according to another embodiment of the present invention.
Figure 9:
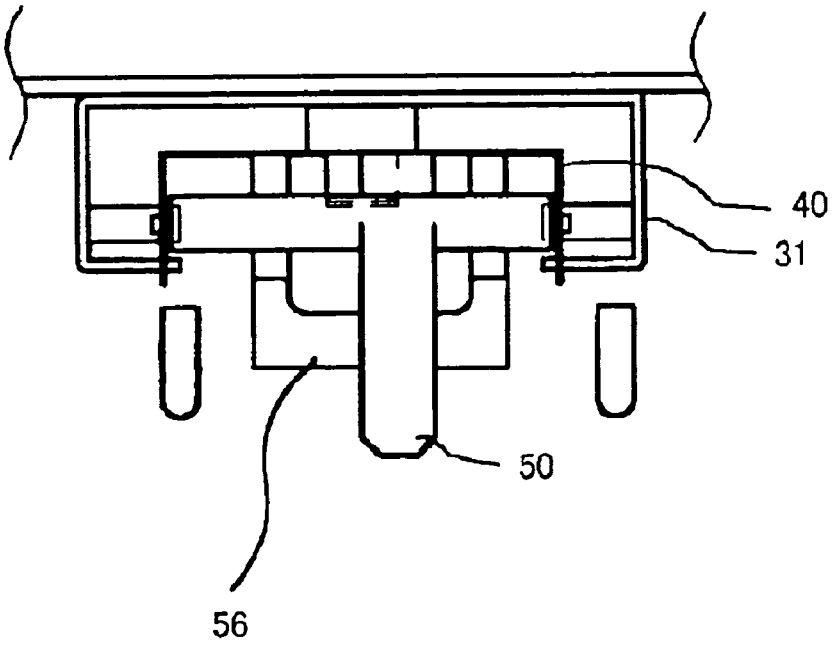
FIG. 9 is a side view of the sheet separating mechanism shown in FIG. 8.

When the paper is further clogged, as shown in FIG. 7, the paper more lifts the separation claw 50 upward, and the separation claw 50 maximally moves within the range of movement. In this state, the projection 53 of the separation claw 50 is brought into contact with the separation claw stopper 19, and the claw portion 52 of the separation claw 50 moves in such a direction that the claw portion 52 is separated from the fixing roller 21. For this reason, even though the separation claw 50 is maximally lifted, the claw portion 52 of the separation claw 50 is separated from the fixing roller 21. Therefore, the separation claw 50 does not scratch the fixing roller 21. As is apparent from FIG. 7, although the claw portion 52 of the separation claw 50 is perfectly separated from the fixing roller 21, the breaking force into the fixing roller 21 decreases even though the claw portion 52 is perfectly separated from the fixing roller 21, FIGS. 8 and 9 are front and side views for explaining another embodiment of the present invention. In this embodiment, a leaf spring 56 arranged integrally with a holder 40 is used in place with the torsional spring 55. More specifically, the configuration of the embodiment is designed such that biasing force for bringing the separation claw 50 into contact with the fixing roller 21 is given by the leaf spring 56.

In the holder 40, the torsional spring 55 needs not be set on the separation claw 50 in assembly, the holder 40 can be more easily build.

Exemplary embodiments of the present invention have been described above. However, the present invention is not limited to the embodiments, and various modifications can be effected.

The leaf spring 44 is arranged integrally with the holder member 41. However, although the manufacturing cost disadvantageously increases, the leaf spring 44 and the holder member 41 are independently arranged, and both the leaf spring 44 and the holder member 41 may be fixed to each other by adhesion, welding, or the like.

The fixing roller is assumed to be rotatable. However, the pressing roller may also be rotatable. In addition, the present invention can also be applied to an apparatus in which a separation claw is arranged at a position where an elastic belt or film is handed on an arbitrary roller of a belt fixing device in which the elastic belt or film is hanged on a plurality of rollers. Furthermore, it is apparent that the sheet separating mechanism can be employed as a photosensitive drum or a photosensitive belt which uses a separation claw.

The sheet separating mechanism according to the present invention has such a structure that it can be assembled easily. Moreover, the sheet separating mechanism has lesser parts so that it can be manufactured at a lower cost. If the sheet separating mechanism according to the present invention is used in an image forming apparatus, the image forming apparatus can be manufactured at a lower cost.

Although the invention has been described with respect to a specific embodiment for a complete and clear disclosure, the appended claims are not to be thus limited but are to be construed as embodying all modifications and alternative constructions that may occur to one skilled in the art which fairly fall within the basic teaching herein set forth.

What is claimed is:

1. A sheet separating device, comprising:

a claw disposed opposite a roller and configured to separate a recording medium from the roller;

a first retaining member configured to retain the claw and to permit the claw to rotate relative to the first retaining member;

a second retaining member configured to retain the first retaining member and to permit the first retaining member to rotate relative to the second retaining member, and a biasing member disposed between the first and second retaining members to bias the first retaining member away from the second retaining member, wherein each of the first retaining member and the second retaining member comprises contact sections configured to contact one another to limit the rotation of the first retaining member relative to the second retaining member due to the biasing member.

2. The sheet separating device according to claim 1, wherein the biasing member comprises a spring member.

3. The sheet separating device according to claim 1, further comprising:

a biasing device configured to bias the claw relative to the first retaining member.

4. The sheet separating device according to claim 3, wherein the biasing device and member each comprise a spring member.

5. The sheet separating device according to claim 3, wherein the second retaining member is configured to connect to a body portion of an image forming apparatus.

6. An image forming apparatus, comprising:

a fixing device including a fixing roller;

a claw disposed opposite the fixing roller and configured to separate a recording medium from the fixing roller;

a first retaining member configured to retain the claw and to permit the claw to rotate relative to the first retaining member;

a second retaining member configured to retain the first retaining member and to permit the first retaining member to rotate relative to the second retaining member, the second retaining member connected to a body of the image forming apparatus, and a biasing member disposed between the first and second retaining members to bias the first retaining member away from second retaining member, wherein each of the first retaining member and the second retaining member comprises contact sections configured to contact one another to limit the rotation of the first retaining member relative to the second retaining member due to the biasing member.

7. A sheet separating mechanism comprising a separation claw configured to engage a surface of a rotatable member located adjacent to said separation claw, a holder configured to rotatably hold said separation claw through a rotating shaft, and a supporting section configured to rotatably support said holder, wherein said holder further comprises a leaf spring, and said supporting section further comprises a first abutting section to be abutted against said leaf spring and a second abutting section to be abutted against a part of the main body of said holder facing against said first abutting section.

8. The sheet separating mechanism according to claim 7, wherein said holder is provided with a protruding portion to which said second abutting section is abutted.

9. The sheet separating mechanism according to claim 7, wherein said holder is equipped with a stopper for limiting the rotational movement of said separation claw in the direction towards said rotatable member.

10. The sheet separating mechanism according to claim 7, wherein said holder is provided with a resilient member for urging said separation claw towards said rotatable member.

11. A fixing device equipped with the sheet separating mechanism as claimed in claim 7.

12. An image forming apparatus equipped with the fixing device as claimed in claim 8.

* * * * *